United States Patent [19]

Fuhrmann et al.

[11] Patent Number: 4,944,866

[45] Date of Patent: Jul. 31, 1990

[54] PROCESS FOR THE HYDROGENATION OF COAL

[75] Inventors: Klaus Fuhrmann, Everskamp; Ulrich Graeser, Haltern; Ludwig Merz, Recklinghausen, all of Fed. Rep. of Germany

[73] Assignee: Veba Oel Technologie GmbH, Gelsenkirchen, Fed. Rep. of Germany

[21] Appl. No.: 852,391

[22] Filed: Apr. 15, 1986

Related U.S. Application Data

[63] Continuation of Ser. No. 595,036, Mar. 29, 1984, abandoned.

[30] Foreign Application Priority Data

Mar. 3, 1983 [DE] Fed. Rep. of Germany ..... 3311552

[51] Int. Cl.[5] ..... C10G 1/06

[52] U.S. Cl. ..... 208/408; 208/413; 208/415; 208/418; 208/434

[58] Field of Search ..... 208/8 LE, 10, 11 LE, 208/14

[56] References Cited

U.S. PATENT DOCUMENTS

| | | | |
|---|---|---|---|
| 1,986,593 | 1/1935 | Morrell | 196/56 |
| 3,700,584 | 10/1972 | Johanson et al. | 208/10 |
| 3,755,137 | 8/1973 | Schuman | 208/10 |
| 3,870,621 | 3/1975 | Arnold et al. | 208/8 LE |
| 4,054,504 | 10/1977 | Chervenak et al. | 208/10 |
| 4,111,786 | 9/1978 | Sugimura et al. | 208/8 LE |
| 4,221,654 | 9/1980 | Slein et al. | 208/8 LE |
| 4,309,191 | 1/1982 | Hiroya et al. | 208/8 R |
| 4,325,801 | 4/1982 | Kuehler | 208/8 LE X |
| 4,339,328 | 7/1982 | Stadelhofer et al. | 208/8 LE |
| 4,405,437 | 9/1983 | Kulik et al. | 208/10 |
| 4,473,460 | 9/1984 | Küerten et al. | 208/10 |

FOREIGN PATENT DOCUMENTS

| | | | |
|---|---|---|---|
| 54-11903 | 1/1979 | Japan | 208/8 LE |

*Primary Examiner*—Asok Pal

*Attorney, Agent, or Firm*—Oblon, Spivak, McClelland, Maier & Neustadt

[57] ABSTRACT

A process for the hydrogenation of coal which entails slurrying pulverized coal with oil, hydrogenating the mixture at an elevated temperature and pressure and separating the liquid and solid reaction products from the gaseous reaction products, wherein the slurry oil contains non-process derived hydrocarbon mixtures having a boiling range above about 200° C., in the amount of about 30–100% by weight with the remainder of the slurry oil being process derived oils having a boiling range above about 200° C.

6 Claims, 2 Drawing Sheets

PROCESS FOR THE HYDROGENATION OF COAL

This application is a continuation of application Ser. No. 595,036, filed Mar. 29, 1984, now abandoned.

BACKGROUND OF THE INVENTION

1. Field of the Invention

This invention relates to a multistage coal hydrogenation process and more particularly to special types of slurry oils for liquid phase coal hydrogenation.

2. Description of the prior Art

Presently, all coal hydrogenation processes use process derived oils for slurrying the coal feed in recognition of the principle that slurry oils must be chemically identical to coal oils. For example, see W. Krönig:Die Katalytische Druckhydrierung von Kohlen, Teeren und Mineralölen, Berlin/Göttingen/Heidelberg, 1950, page 76. However, there is some indication that non-process derived oils could be used as feedstocks for coal hydrogenation process, for example, as starting oils. See W. Krönig, id at 42.

It would, indeed be desirable to be able to use non-process derived oils for coal slurrying. A coal hydrogenation process using such oils would be very cost effective due to the avoidance of expensive process derived oil use. Unfortunately, to date, such expensive process derived oils have been used almost exclusively for slurrying the coal feed.

Thus, a need clearly continues to exist for a less expensive, but equally effective, alternative slurrying oil for coal hydrogenation processes.

SUMMARY OF THE INVENTION

Accordingly, it is an object of the present invention to provide a process for the hydrogenation of coal which uses different specially appropriated process or non-process derived oils, at least partially, for slurrying pulverized coal.

It is also an object of this invention to provide an improved design for combining the liquid phase coal hydrogenation step with a further gas phase hydrogenation step using the reaction pressure and reaction temperature of the liquid phase hydrogenation.

According to the present invention, the foregoing and other objects are attained by providing a process for the hydrogenation of coal which entails slurrying pulverized coal with oil, hydrogenating the mixture at an elevated temperature and pressure, and separating the liquid and solid reaction products from the gaseous reaction products, wherein the slurry oil consists of non-process derived hydrocarbon mixtures having a boiling range above about 200° C., in the amount of about 30–100% by weight, with the remainder of the slurrying oil being process derived oils having a boiling range above about 200° C.

DETAILED DESCRIPTION OF THE PREFERRED EMBODIMENT

Figure 1:
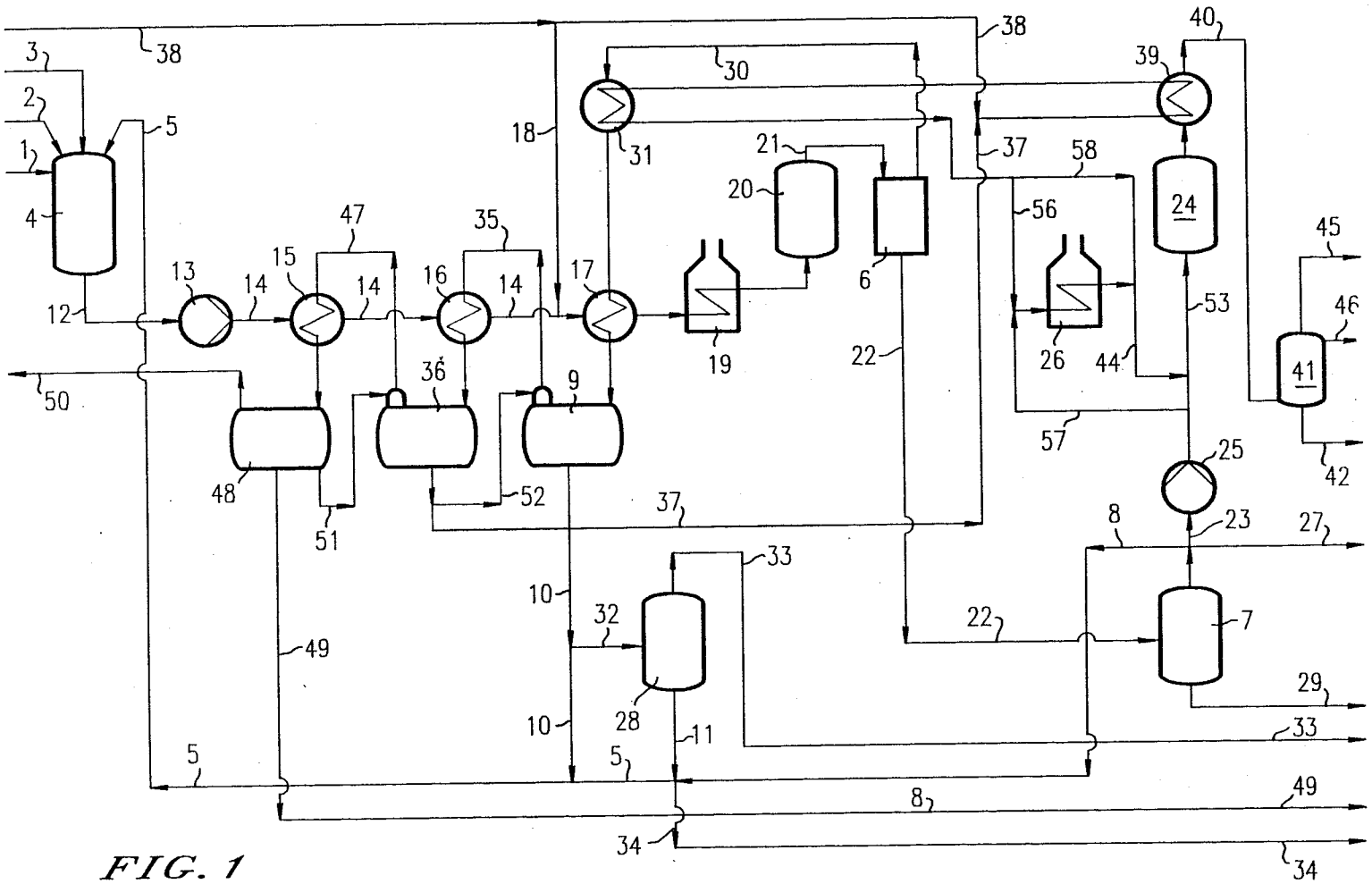
FIG. 1 shows the process configuration in which only a part of the liquid phase product is fed to the gas phase hydrogenation.

According to the present invention a coal hydrogenation process is provided whereby particular process or non-process derived oils are used, at least partially, for slurrying pulverized coal. Further, an improved design is provided for combining the liquid phase coal hydrogenation step with a further gas phase hydrogenation step using the reaction pressure and reaction temperature of the liquid phase hydrogenation by which it is possible to provide selected fractions of the liquid yields as feedstocks for the gas phase hydrogenation. Moreover, portions of the oil yield gained in the liquid phase hydrogenation may be advantageously used for slurrying the coal. Pulverized coal is slurried by a mixture of process or non-process derived oils, and is hydrogenated under pressure of about 100 up to about 700 bar and at temperatures of about 400 up to about 520° C., preferably of about 400° C. up to about 490° C. in a—so called—liquid phase hydrogenation step. If necessary a catalyst is added. The mixture leaving the liquid phase hydrogenation step is separated into (1) a fraction which is condensable under the conditions of the separation containing the non-distillable fractions as well as the non-converted coal and eventually catalysts and (2) into a fraction which distills under the conditions of the separation containing the liquid yield respective portions and the gas recycled using one or more hot separators at process pressure and temperature.

By means of fractionated condensation using heat exchange with feedstocks and under the process pressure, at least 3 liquid fractions are obtained from the hot separator overhead.

At least one of these 3 fractions is the feedstock for a—so called—gas phase hydrogenation to which it is fed using process pressure and temperature for further hydrogenation in the presence of catalyst.

The feed for the gas phase hydrogenation should have a boiling range of about 180°–450° C., preferably about 200°–350° C. Fractions with a boiling range of more than about 250° C., preferably of more than about 350° C. are at least partially recycled and used after depressurizing to atmospheric pressure as part of the slurry oil.

Herewith and in the following the recited temperature for boiling ranges refers to that under atmospheric pressure (1 bar). Up until the present invention, all coal hydrogenation processes used process derived oils for slurrying the coal feed following the principle that slurry oils must be chemically identical to coal oils. Contrary to this doctrine it has been found that special non-process derived hydrocarbon mixtures can advantageously be used as slurry oils. Due to this it has been found that it is not necessary to recycle a fixed quantity of process derived oil as slurry oil. By this finding, the process flexibility for product qualities and for the product spectrum is greatly increased.

According to the present invention, the non-process derived hydrocarbon mixture as well as the process derived oils used as slurry oil should have a boiling range above about 200° C., preferably above about 300° C. While it has already been noted that there is some indication in the literature that non-process derived oils might be used as feedstocks for coal hydrogenation processes, in such uses, the portion of non-process derived oils never exceeds 20% by weight of the total slurry oil demand.

According to the present invention however, the portion of the non-process derived hydrocarbon mixture in the slurry oil is advantageously higher than about 30 weight %, preferably higher than about 50 weight % and can be increased up to about 95 weight %. Special suitable hydrocarbon mixtures like heavy oils with extremely low paraffin content can even be used alone as slurry oils.

In general, high naphthenic and aromatic mineral oils and preferably heavy and, still better, the heaviest mineral oils as well as mineral oil derived top and/or vacuum residues and oils derived from oil-shale and tar-sand upgrading yields, for instance by retorting processes, have proven to be surprisingly suitable as slurry oils or slurry oil components by providing a high asphaltene dissolving power. Therefore, the quantity of process derived slurry oils can be reduced dependent on the quality and origin of the non-process derived hydrocarbon mixtures. This allows for an increase in the liquid yield for the liquid and gas phase hydrogenation step by gaining the otherwise recycled hydrogenation products. The withdrawn quantity of precious hydrogenation products will be replaced by less precious non-process derived hydrocarbon mixtures. Depending on the quality and origin of the non-process derived hydrocarbon mixtures, the total slurry oil quantity can be provided by such feedstocks of low quality which are hydrogenated to products of high value.

By the direct combination of liquid-and gas phase hydrogenation without an intermediate depressurizing step, the process according to this invention is technically optimized: Apart from the energetic advantages, undersired reactions of thermally unstable and reactive oil products of the liquid phase hydrogenation are avoided during the otherwise needed atmospheric distillation.

This is extremely important if heavy mineral oil derived hydrocarbon mixtures, with high coking tendencies, and heavy mineral oils or heavy oils from oil shale or tar sand processing, which are highly unstable and have gum formation tendencies, are used as slurry oils. The mixtures of coal and mineral oil derived hydrogenation products tend to be unstable and, moreover, tend easily to separate into components, especially if the feedstocks have been less intensely hydrogenated in the liquid phase.

In addition, the fractioned condensation of the gaseous liquid phase products under the process pressures allows the adaptation of the oil quantity and oil quality for recycling as slurry oil, to the quantity and nature of the non-process derived slurry oil.

In processes using only process derived products as slurry oil, one objective is to increase the ratio between the coal and slurry as much as possible, in order to keep the expensive reaction space of the liquid phase hydrogenation low.

Weight ratios of 1:2 up to 1:1 are achieved. However in the present process precious hydrogenation products are gained not only from coal but also from the non-process derived hydrocarbon mixture used. It may be suitable to choose lower coal contents down to about 1:20. Preference is given to weight ratios between coal and slurry oil ranging from about 1:5 up to about 4:5.

Apart from the process derived oil gained by fractioned condensation from the gaseous product of the liquid phase hydrogenation, the oil yield can be preferably utilized. This is recovered by processes for solid enrichment of hot separator bottom streams which are solid or liquid at the reaction temperature and reaction pressure and at temperatures ranging some degrees lower. As mentioned above, this oil is separated before the gas phase hydrogenation and the fractionated condensation of the gaseous liquid phase product. The solid enrichment is processed conventionally for example by vacuum distillation, coking and low-temperature carbonization. Aside from the suitable non-process derived hydrocarbon mixtures the oil recovered by solid enrichment of hot separator bottom streams can be used by itself as the sole process-derived quantity of the slurry oil.

Two forms of processing according to the invention will be described hereinbelow with regard to FIG. 1 and FIG. 2. FIG. 1 shows the process mode in which only a part of the liquid phase product is fed to the gas phase hydrogenation.

Pulverized and dried coal is fed by pipe 1, if necessary by adding a catalyst over pipe 2, together with a non-process derived oil from pipe 3 into vessel 4 where the slurry consisting of coal and liquid hydrocarbons is prepared. If necessary one or more process derived oils may be added to the slurry by pipe 5.

Process derived oil can be provided either by pipe 8 as residual oil, e.g. vacuum gas oil yielded by the upgrading step 7 of the hot separator bottom product or by pipe 10 as an oil condensate from separator 9, if necessary after removal of the light ends by use of an atmospheric distillation 28. The slurry is fed by pipe 12 to pump 13 where it is pressurized to about 100 up to about 700 bar and is pumped over pipe 14 passing the heat exchangers 15 and 16 and, after addition of hydrogen by pipe 18, to heat exchanger 17. After further preheating in preheater 19 the slurry is fed to the liquid phase hydrogenation which in general consists of several reactors connected in series.

The reaction products leave the reaction by pipe 21 and are separated in separator (6).

The hot separator bottoms consisting of unconverted coal, eventually catalysts, asphaltenes, pre-asphaltenes and high boiling residual oil leave the hot separator over pipe 22 in order to be processed further for example by vacuum distillation (7) or retorting processes (7) to yield high boiling oil and residue. The oil or parts of it will be recycled either over pipes 8 and 5 into the slurry mixing vessel 4, or over pipes 23 and 53 with intermediate recompression by pump 25 to the gas phase hydrogenation 24.

The product leaving pump 25 over pipe 57 may be heated u in the preheater 26 and fed to the gas phase hydrogenation over the pipes 44 and 53. In addition, residual oil can be separated out of the process over pipe 27. The residue of the so processed hot separator bottom product leaves the process by pipe 29.

The hot separator top products being gaseous at the conditions pass heat exchanger 31 over pipe 30 and are partially condensed by heat exchange against the fresh slurry in heat exchangers 17, 16 and 15 using the pressure of the previous liquid phase hydrogenation.

The liquid fraction leaving separator 9 is fed after being depressurized and after removal of the dissolved gases to the slurry mixing vessel 4 by pipes 10 and 5. It is also possible to fractionate this fraction further in an atmospheric distillation 28 following pipe 32. In the atmospheric distillation the light components may be separated and removed from the process by pipe 33. The heavier fractions are fed into the slurry mixing vessel 4 over pipes 11 and 5 or may be removed from the process over pipe 34.

After additional heat exchange against the fresh slurry by heat exchanger 16 the gaseous fraction from separator 9 is fed into separator 36 over pipe 35. The resulting liquid fraction is fed to the gas phase hydrogenation over the pipes 37, 58, 44 and 53 after hydrogen is added over pipe 38 and after heat exchange with the products of the liquid phase and gas phase hydrogenation in neat exchangers 39 and 31. Eventually this stream may be heated additionally in preheater 26 and is added to the gas phase hydrogenation over pipes 56, 44 and 53. Thereby the process pressure of the liquid phase hydrogenation is used for the gas phase hydrogenation. The reaction products from the gas phase hydrogenation 24 pas heat exchanger 39 and are fed to an atmospheric distillation 41 over pipe 40 after being depressurized.

The resulting heavy products leave the process by pipe 42. The gaseous products obtained from the distillation 41 are removed from the process by pipe 45, the lighter liquid products by pipe 46.

The gaseous products obtained in separator 36 are fed into separator 48 over pipe 47 after heat exchange against the fresh slurry in heat exchanger 15. The so gained liquid products leave the process by pipe 49. The gaseous products from separator 48 leave the process by pipe 50 and are fed to a gas treating section (not shown). In order to improve the fractionating efficiency of the separators 9 and 36 these are designed as high pressure columns with liquid recycling 51, 52.

Figure 2:
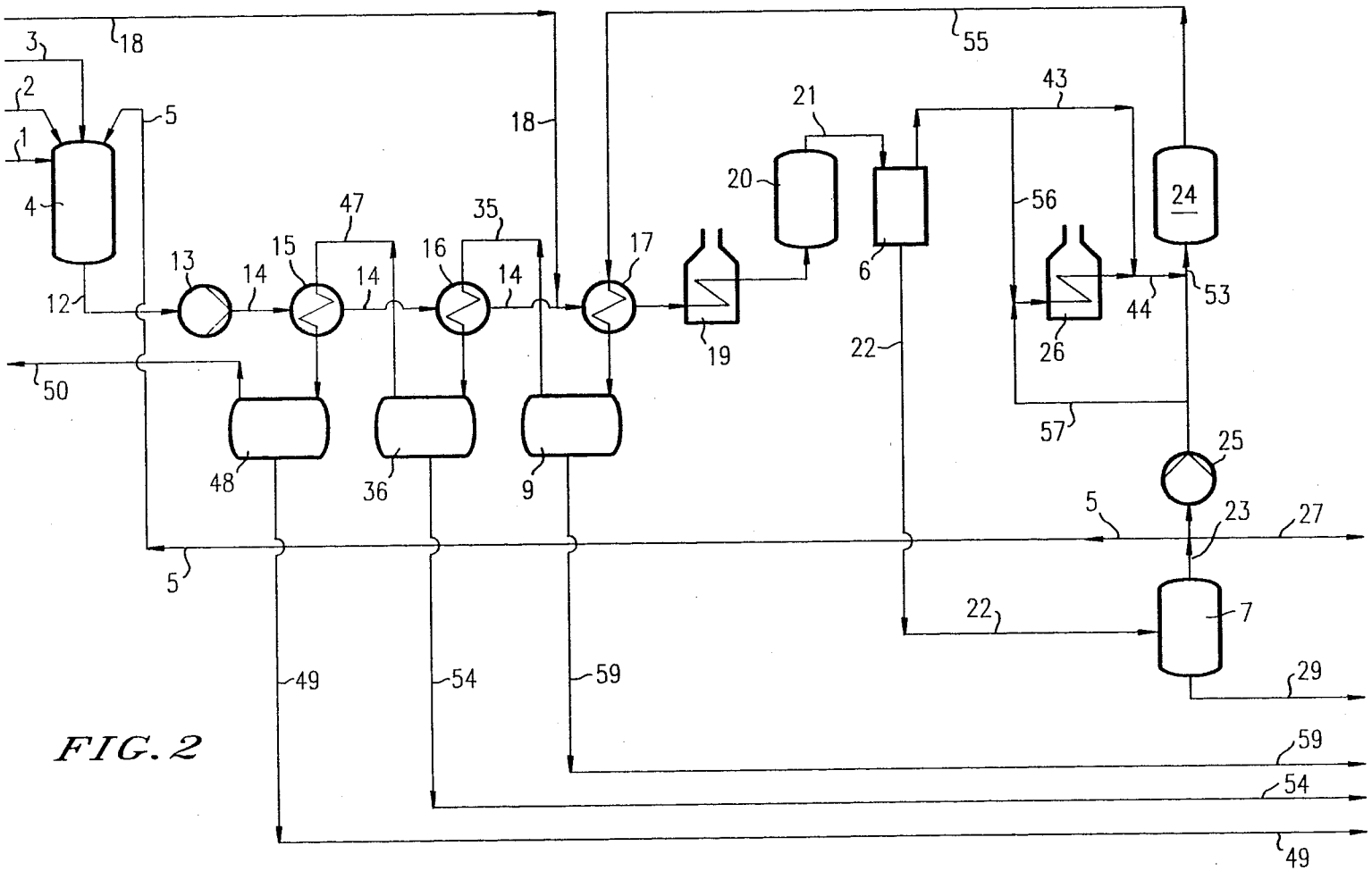
FIG. 2 shows the process configuration by which the total gaseous product of the liquid phase hydrogenation is further hydrogenated in the gas phase step.

FIG. 2 shows the process configuration by which the total gaseous product of the liquid phase hydrogenation is further hydrogenated in the gas phase step. Pulverized and dried coal from pipe 1 is mixed in the slurry mixing vessel 4 with a non-process derived hydrocarbon mixture supplied by pipe 3. Eventually one or more catalysts may be added over pipe 2.

If desired, a process derived oil gained for example, by the upgrading of the hot separator bottoms, may be added over pipes 23 and 5. The resulting mixture has a solids content in the range of about 5 to about 50 weight %.

The slurry is fed to the liquid phase hydrogenation after being pressured by pump 13 up to about 100 to 700 bar after being pumped through neat exchangers 15, 16 and 17 and after being heated in the preheater 19. In general the liquid phase hydrogenation consists of several reactors connected in series. Hydrogen is added over pipe 18 to the slurry. The reaction products leave the liquid phase hydrogenation over pipe 21 and are separated in hot separator 6.

The hot separator bottoms, consisting of unconverted coal, eventually one or more catalysts, asphaltenes, pre-asphaltenes and high boiling oils, are fed by pipe 22 to an upgrading section 7, e.g. a vacuum distillation or retorting steps in order to yield a high boiling residual oil and a residue. The residual oil is fed over pipes 23 and 5 into the slurry mixing vessel or is fed into the gas phase hydrogenation over pipes 23 and 53 after being recompressed by high pressure pump 25 to the pressure of the gas phase hydrogenation. If necessary the product leaving pump 25 over pipe 57 may be heated up in the preheater 26 and fed into the gas phase hydrogenation 24 by pipes 44 and 53. The residual oil may also be withdrawn out of process by pipe 27.

The remaining products of the hot separator bottoms upgrading unit 7 leave the process by pipe 29.

The hot separator top products being gaseous at the conditions leave the hot separator 6 and are fed into the gas phase hydrogenation 24 by pipes 43, 44 and 53 using the pressure and temperature of the liquid phase hydrogenation, if necessary after additional preheating in preheater 26 by pipes 56, 44 and 53.

The products of the gas phase hydrogenation 24 are partially condensated by heat exchange against the fresh slurry in heat exchangers 15, 16 and 17 using the pressure of the gas phase hydrogenation. The products are fed to the heat exchanger system by pipe 55.

From separator 9 following heat exchanger 17 the resulting liquid fraction, preferably consisting of oil in the vacuum gas oil boiling range, leaves the process by pipe 59.

The gaseous fraction from separator 9 is fed into separator 36 over pipe 35 after being heat exchanged with the fresh slurry in heat exchanger 16. The resulting liquid fraction, preferably a fraction of the naphtha boiling range leaves the process over pipe 54.

The gaseous products from separator 36 are fed to exchanger 15 and separator 48 by pipe 47. Condensated components leave the process by pipe 49, remaining gaseous products from separator 48 leave the process by pipe 50 and are fed to a gas treating unit which is not shown.

Having now fully described this invention, it will be apparent to one of ordinary skill in the art that many changes and modifications can be made thereto without departing from the spirit or scope of the invention as set forth herein.

What is claimed as new and desired to be secured by Letters Patent of the United States is:

1. A process for the hydrogenation of coal, which comprises:

slurrying pulverized coal with an oil, wherein the coal and oil are slurried in a weight ratio of coal:oil of from about 1:20 to 1:1, said oil consisting of a non-process derived hydrocarbon mixture having a boiling range above about 200° C., in an amount of 40–100% by weight and selected from the group consisting of mineral oils containing substantial amounts of aromatic and naphthenic compounds, mineral oil derived top residue, vacuum residue, heavy oils, oils obtained from the retorting of oil shales or tar sands, and mixtures thereof, and the remainder of said oil being process-derived oils having a boiling range above about 200° C., and obtained by fractionated condensation of the gaseous product leaving a hot separation step following, hydrogenating the mixture of coal and oil at an elevated temperature of about 350°–520° C. and under hydrogen pressure of about 100–1,000 bar, in a liquid-phase hydrogenation step to yield a product mixture, using at least one hot separation step to separate said product mixture into a gaseous non-condensed fraction and into liquid and solid products and wherein oil obtained by fractionated condensation of the gaseous product or an oil obtained by the solid enrichment of the separated liquid and solid products as used, at least partially, as the process derived portion of the slurry oil; and further hydrogenating the remainder of said gaseous product, without depressurizing the gas phase over fixed bed catalysts.

2. The process of claim 1, wherein the hydrogenation of the coal and oil mixture is effected under hydrogen pressures of about 250 to 700 bar and at a temperature of about 440 to 490° C.

3. The process of claim 1 wherein an oil obtained by fractionated condensation of the gaseous product is used, at least partially, as the process derived portion of the slurry oil.

4. The process of claim 1, wherein an oil obtained by the solid enrichment of the separated liquid and solid products is used, at least partially, as the process derived portion of the slurry oil.

5. The process of claim 1, wherein said coal/slurry ratio is between about 1:5 and 4:5.

6. The process of claim 1 wherein the non-process derived hydrocarbon mixture is contained in an amount from 50 to about 95% by weight.

* * * * *